US005542868A

United States Patent [19]

Kozuka

[11] Patent Number: 5,542,868

[45] Date of Patent: Aug. 6, 1996

[54] METHOD AND APPARATUS FOR STRETCHING A DAMPER WIRE

[75] Inventor: Sadao Kozuka, Aichi, Japan

[73] Assignee: Sony Corporation, Tokyo, Japan

[21] Appl. No.: 398,321

[22] Filed: Mar. 3, 1995

[30] Foreign Application Priority Data

Mar. 16, 1994 [JP] Japan ..... 6-071499

[51] Int. Cl.[6] ..... H01J 9/16

[52] U.S. Cl. ..... 445/37; 219/58

[58] Field of Search ..... 445/37; 219/56.22, 219/58

[56] References Cited

U.S. PATENT DOCUMENTS

| | | | |
|---|---|---|---|
| 4,020,315 | 4/1977 | Euler | 219/56.22 |
| 4,682,965 | 7/1987 | Kume et al. | 219/56.22 X |
| 4,780,641 | 10/1988 | Hashiba et al. | 313/269 |
| 5,382,871 | 1/1995 | Funahashi et al. | 445/37 X |

FOREIGN PATENT DOCUMENTS

| | | |
|---|---|---|
| 59-52505 | 2/1977 | Japan . |
| 62-188133 | 8/1987 | Japan . |
| 4-224083 | 8/1992 | Japan . |
| 5-121008 | 5/1993 | Japan . |
| 5-198259 | 8/1993 | Japan . |
| 5-275025 | 10/1993 | Japan . |
| 5-290752 | 11/1993 | Japan . |
| 5-325814 | 12/1993 | Japan . |
| 6-139948 | 5/1994 | Japan . |
| 6-236735 | 8/1994 | Japan . |

*Primary Examiner*—Kenneth J. Ramsey
*Attorney, Agent, or Firm*—Peter C. Toto; Jerry A. Miller

[57] ABSTRACT

A method for attaching a stretched damper wire to a cathode ray tube including the steps of locating each end of a damper wire at a first position with respect to a pair of damper springs and welding each end of the damper wire to each of the damper springs while holding the damper wire between each of the damper springs and a welding ribbon. Next, the damper springs are moved to a frame of the cathode ray tube and welded at second positions thereof to upstanding portions of said frame so as to stretch the damper wire between the damper springs on an aperture grill.

5 Claims, 4 Drawing Sheets

METHOD AND APPARATUS FOR STRETCHING A DAMPER WIRE

FIELD OF THE INVENTION

This invention relates to a method for stretching a damper wire used for a cathode ray tube. More particularly, this invention relates to a method for stretching a damper wire used for a cathode ray tube to prevent vibration of an aperture grill.

BACKGROUND

A color cathode ray tube uses an aperture grill having a plurality of color selective electrodes (grill tapes) which are obtained by forming a number of vertical stripe slits on a metal plate by selective etching. In the color cathode ray tube of this type, the grill tapes can be vibrated by a loud sound or impact, thereby resulting in a deterioration in image quality.

To reduce this problem, a damper wire is horizontally stretched along the aperture grill surface to prevent vibration of the grill tape. The number of the damper wires can be one or more. For example, one for a small sized tube of 14 to 16 inches; two for a medium sized tube of 18 to 25 inches; and three for a large sized tube of 25 inches or more.

Conventionally, the above-described stretching of a damper wire has been manually performed.

The manual stretching of a damper wire creates problems in that the stretching operation takes a relatively long amount of time, requires an operator of a very high skill level, and results in a product of variable quality.

SUMMARY OF THE INVENTION

One object of the present invention is to provide a new and improved method for attaching a stretched damper wire to a cathode ray tube.

Another object of the present invention is to provide a new and improved apparatus for attaching a stretched damper wire to a cathode ray tube.

According to the first embodiment of the present invention, a method for attaching a stretched damper wire to a cathode ray tube includes the steps of locating each end of a damper wire at a first position of each of a pair of damper springs and welding each end of the damper wire to each of the damper springs while holding the damper wire between each of the damper springs and a ribbon used for welding. Further, the method includes the steps of positioning the damper springs with respect to a frame of the cathode ray tube, and welding each of the damper springs at respective second positions onto upstanding positions of the frame so as to stretch the damper wire between the damper springs on an aperture grill.

According to the second embodiment of the present invention, an apparatus for attaching a stretched damper wire to a cathode ray tube includes a damper wire assembly forming apparatus for forming a damper wire assembly having a pair of damper springs and a damper wire stretched between the damper springs, a damper wire assembly welding apparatus for positioning the damper springs on a frame and welding the damper springs on a pair of upstanding portions of the frame, and a damper assembly carrying mechanism for carrying the damper assembly formed by the damper assembly forming apparatus from the damper assembly forming apparatus to the damper assembly welding apparatus.

DESCRIPTION OF THE INVENTION

A method for stretching a damper wire of the present invention will be explained, making reference to the drawings.

Figure 1A:
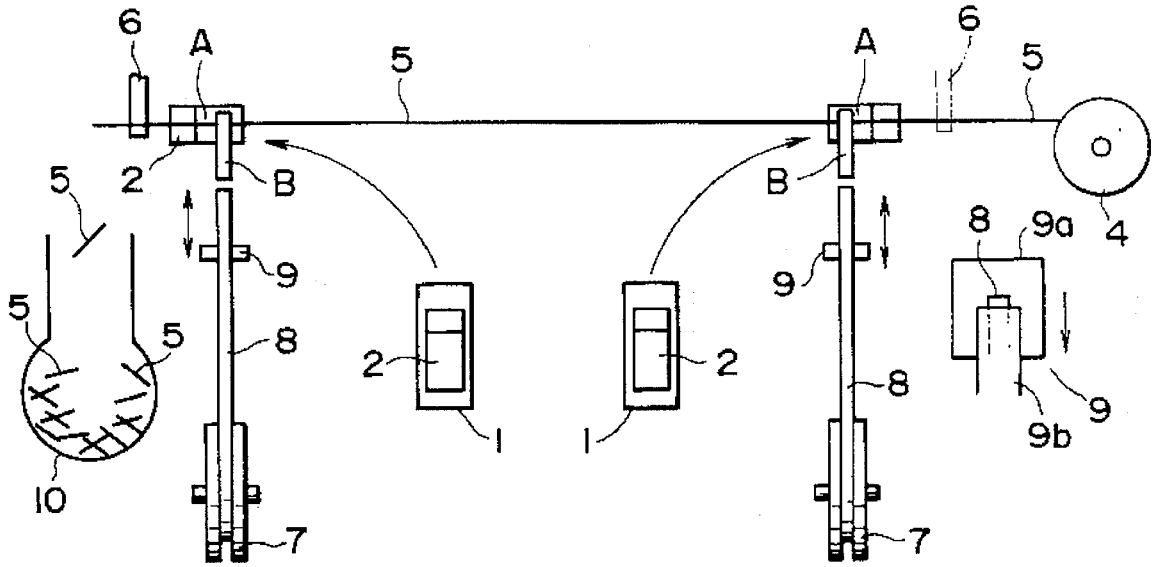
FIG. 1(A) is a plan view showing a method of forming a damper assembly of the present invention.
Figure 1B:
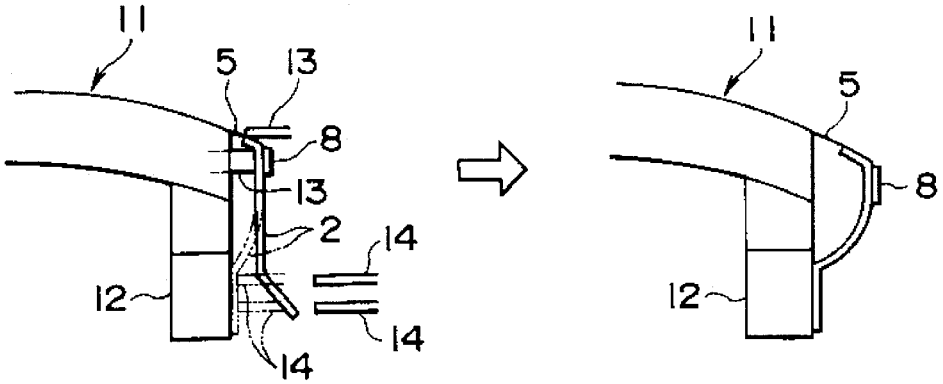
FIG. 1(B) is a sectional view showing a method of welding a damper assembly of the present invention.
Figure 2A:
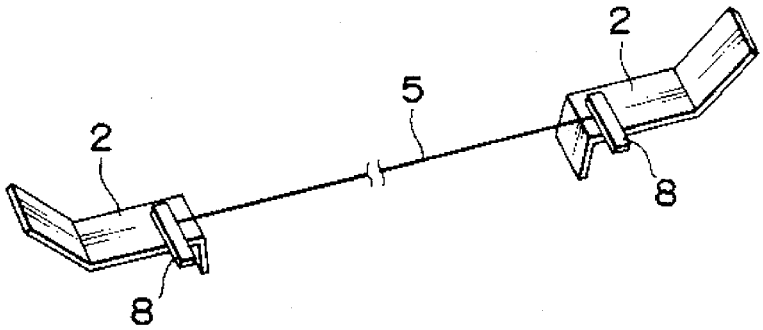
FIG. 2(A) is a perspective view showing a damper assembly.
Figure 2B:
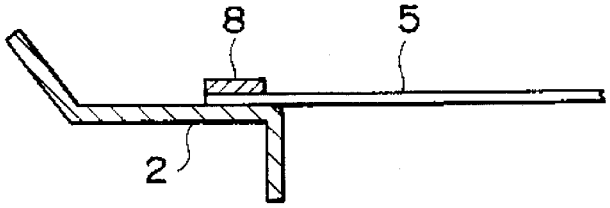
FIG. 2(B) is a sectional view showing a damper assembly.
Figure 3:
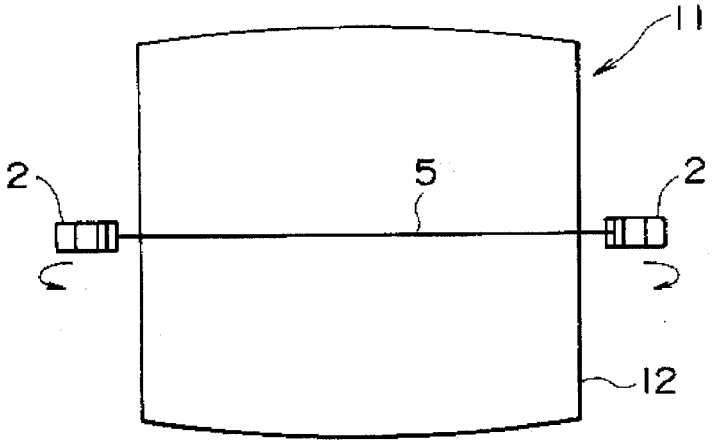
FIG. 3 is a plan view showing the state slightly before damper springs are welded onto a frame of an aperture grill of a cathode ray tube.

FIG. 1(A) and FIG. 1(B) show an embodiment of a method for stretching a damper wire of the present invention. FIG. 1(A) is a plan view showing a method for forming a damper assembly. FIG. 1(B) is a sectional view showing a method for welding a damper spring onto a frame of an aperture grill of a cathode ray tube (sometimes referred to as a B-member). FIG. 2(A) is a perspective view showing a damper assembly. FIG. 2(B) is a sectional view showing a damper assembly. FIG. 3 is a plan view showing the state slightly before the damper springs of a damper assembly are each welded into place.

First, a method for forming a damper assembly will be described with reference to FIG. 1(A).

A number of damper springs 2 (each being previously formed to a predetermined shape) used for a damper assembly are contained in magazines 1. Two damper springs 2 are each removed from respective magazines 1 and are positioned perpendicular to the magazines 1. The damper springs 2 are held in position by suitable means well known to those in the art.

A damper wire 5 wound around a damper wire reel 4 is provided adjacent the position of the damper springs 2 and shown on the right side of FIG. 1(A). The damper wire 5 is drawn by a wire clamper 6 while being regulated in tension by a tension regulator (not shown in FIG. 1 but fully described later). The wire clamper 6 is movable between the two positions shown in FIG. 1(A) (one position shown by the solid line and the other by the broken line). The wire clamper 6 draws the damper wire 5 to the position shown in FIG. 1(A), so that the damper wire 5 extends between the two positioned damper springs 2.

The damper wire 5 is pressed against the two damper springs 2 in conventional fashion at two points A of FIG. 1(A). The two points A are located slightly outward from positions where the two damper springs 2 are to be welded.

A ribbon suitable for welding 8, wound around a pair of ribbon reels 7 is drawn by a ribbon clamper 9. The leading edge of the ribbon 8 covers the portion where the damper spring 2 is to be welded. FIG. 1(A) shows a section of the ribbon 8 already welded to the damper springs 2. Welding takes place while the damper wire 5 is held between the damper spring 2 and the ribbon 8; the leading edge of the ribbon 8 being seam-welded to the damper spring 2 at the position where the damper wire 5 is held between the ribbon 8 and the damper spring 2. As a result, both ends of the damper wire 5 are fixed between a pair of the damper springs 2.

Thereafter, each of the ribbons 8 is cut at a predetermined position using a cutter which is also part of the ribbon clamper 9 (reference numeral 9*a* designates an upper cutting edge and 9*b* is a lower cutting edge).

The excess damper wire 5 is also cut. In particular, the wire clamper 6 draws the excess portion of the damper wire 5 projecting from the left damper spring 2 in FIG. 1(A) obliquely and upwardly to cut the excess portion of the damper wire 5. After the cutting, the wire clamper 6 releases the damper wire 5. The excess portion of the damper wire 5 is sucked into a refuse containing bag 10 by vacuum suction. The wire clamper 6 is returned to the position to the right damper spring 2 in FIG. 1(A), as shown by the two-dotted lines, and clamps the damper wire 5. The wire clamper 6 draws the excess portion of the damper wire 5 projecting from the right damper spring 2 obliquely and upwardly to cut it. A damper assembly shown in FIG. 2 is thus completed.

Figure 4:
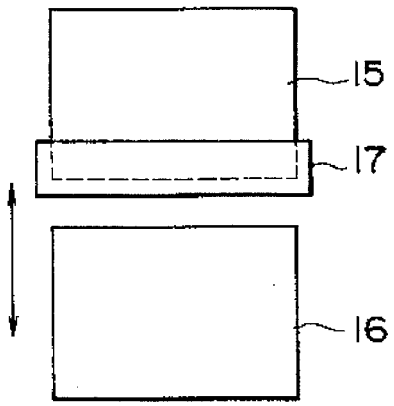
FIG. 4 is a schematic plan view showing one embodiment of a damper wire stretching apparatus of the present invention.
Figure 5:
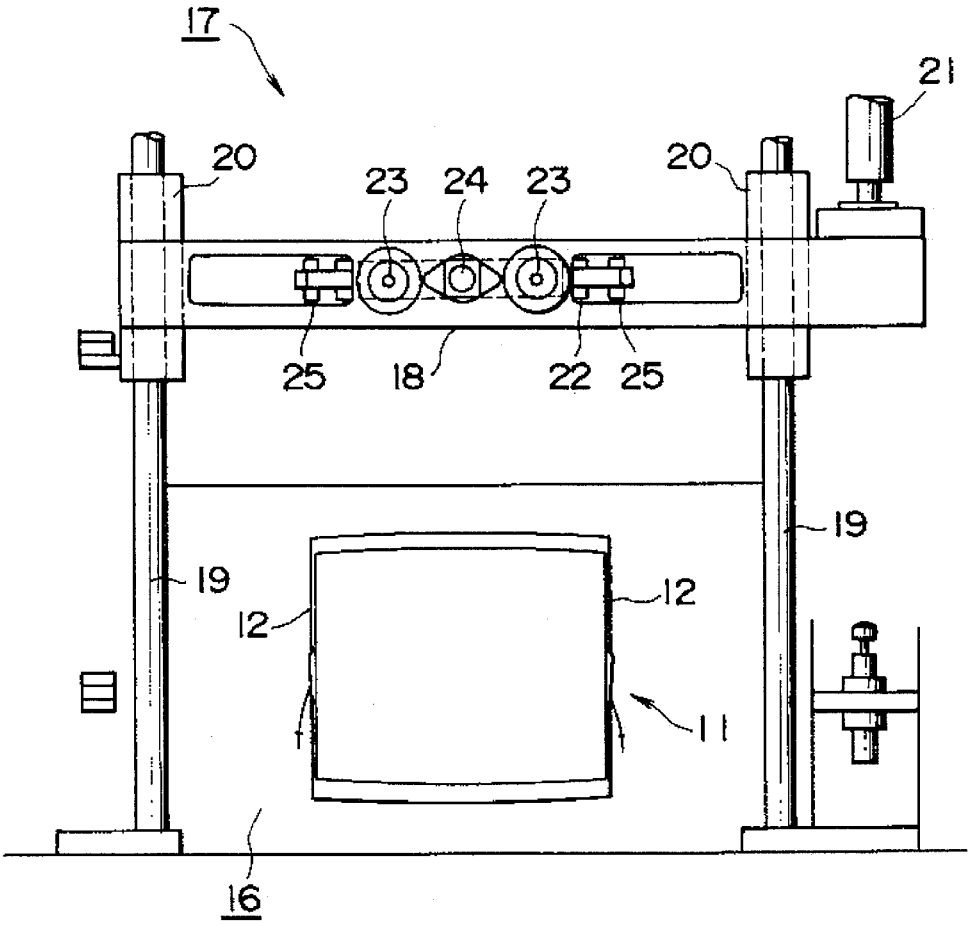
FIG. 5 is a plan view of a damper assembly carrying mechanism.

The damper assembly is carried from a damper assembly forming apparatus to an aperture grill (AG) 11 (FIG. 1(B)) positioned in a damper assembly welding apparatus. FIG. 5 shows a damper assembly carrying mechanism 17, while FIG. 4 shows a representation of the interaction between the damper assembly forming apparatus 15, the damper assembly carrying mechanism 17 and the damper assembly welding apparatus 16.

Each damper spring 2 is welded onto upstanding portions of a frame (or a so-called B member) 12 of an aperture grill as shown in FIG. 1(B). As shown, the damper spring 2 is positioned to be substantially perpendicular to the surface of the aperture grill, and the inside of the damper spring 2 is positioned by a positioning means 13. The damper spring 2 is welded at two points to the frame 12 by spot-welding. Reference numeral 14 shows a welding electrode.

After the completion of welding, the positioning of the damper spring 2 by the positioning means 13 is released. The stretching of the damper wire is thus completed.

According to the above method of stretching a damper wire, a pair of damper springs 2 are positioned apart a predetermined interval. A damper wire 5 is located by a wire clamper 6 in such a manner as to span the two damper springs 2. The damper wire 5 is pressed down against the damper springs 2. Consequently, the damper wire 5 is positioned between a pair of the damper springs 2. Then, the damper wire 5 is fixed between the damper spring 2 and a ribbon 8 by seam-welding. Next, each of the ribbons 8 is cut at a predetermined length. Further, the portion of the wire projecting from each of the damper springs is cut. Accordingly, there can be obtained a damper assembly in which each end of the damper wire 5 is held between the damper spring 2 and the ribbon 8 by seam-welding. This is shown in FIGS. 2(A) and 2(B).

The stretching of the damper wire 5 may be performed for the aperture grill before or after a fluorescent screen is formed on the aperture grill. In the case where the stretching of the damper wire is performed for the aperture grill before a fluorescent screen is formed, the aperture grill on which the damper wire is stretched acts as a mask upon exposure required for formation of a fluorescent screen (formation of carbon stripe, and fluorescent film stripe). Accordingly, there occurs a problem that a shadow due to the damper wire is created, that is, the damper wire is patterned on the fluorescent screen. However, by proceeding in such fashion, there is an advantage that the damper wire prevents the grill tape of the aperture grill from vibrating upon exposure. This prevents the formation of the fluorescent screen from being obstructed by vibration of the grill tape of the aperture grill. At present, it is common that the stretching of the damper wire be performed after a fluorescent screen is formed; particularly with respect to forming a fluorescent screen for a large size cathode ray tube and/or a high, precise cathode ray tube used as a display for a business computer.

FIG. 4 is a schematic plan view of a damper wire stretching apparatus for automatically performing the above-described method for stretching a damper wire. The damper wire stretching apparatus has a damper assembly forming apparatus 15 for automatically forming a damper assembly, a dan:per assembly welding apparatus 16 for automatically positioning an aperture grill 11 and welding damper springs 2 onto a frame member 12 of the aperture grill, and a damper assembly carrying mechanism 17 for automatically carrying a damper assembly from the damper assembly forming apparatus 15 to the damper assembly welding apparatus 16.

In the damper stretching apparatus, the damper assembly forming apparatus 15 and the damper assembly welding apparatus 16 are disposed so as to be close to each other, and further the damper assembly carrying mechanism 17 for carrying a damper assembly is disposed between the damper assembly forming apparatus 15 and the damper assembly welding apparatus 16. As a result, the entire process of stretching of a damper wire can be performed automatically.

FIG. 5 is a plan view of the damper carrying mechanism. A carrying plate 18 is guided through a pair of linear bushings 20 by a pair of guides 19 between the damper assembly forming apparatus 15 and the damper assembly welding apparatus 16 (FIG. 4). An air cylinder 21 is used for carrying the carrying plate 18.

A lift plate 22 is mounted on the lower side of the carrying plate 18, which rises and falls. Vertical guides 23 guide the lift plate 22 vertically. A lifting cylinder 24 drives the lift plate 22 vertically. A damper spring attracting portion 25 is mounted on the lift plate 22, and functions to attract the damper springs 2 of the damper assembly by magnets contained therein. Moreover, a finger and an air cylinder (not shown) are provided for changing the direction of the damper springs 2 by 90°. Specifically, the direction of the damper springs 2 that have completed seam-welding (FIG. 1(A)) is changed so as to make possible spot-welding (FIG. 1(B)) when the damper springs 2 are spot-welded to the frame member 12.

After completing the formation of the damper assembly, the damper assembly carrying mechanism 17 moves the carrying plate 18 over the damper assembly, and lowers the lift plate 22 via lifting cylinder 24. This allows the damper spring attracting portion 25 to attract the damper springs 2 at each end of the damper assembly by magnets. The lift plate 22 is lifted by the lifting cylinder 24, and the carrying plate 18 is carried up to the position of the damper welding apparatus 16 where the damper wire is to be stretched on the aperture grill 11.

After that, the lift plate 22 is lowered, and the direction of the damper spring 2 is changed by the cylinder of the damper spring attracting portion 25 so that the damper spring 2 faces the frame member 12. In such a state, the damper springs 2 are welded onto the frame member 12.

Additionally, in the damper stretching apparatus of the present invention, where two damper wires are stretched onto one aperture grill, the stretching action of a damper wire for one aperture grill may be repeated two times; and where three damper wires are stretched, the above action may be repeated three times.

To improve the efficiency in stretching a plurality of damper wires, two of the damper assembly forming apparatus 15 (FIG. 4) may be provided to form damper assemblies at the same time.

Figure 6:
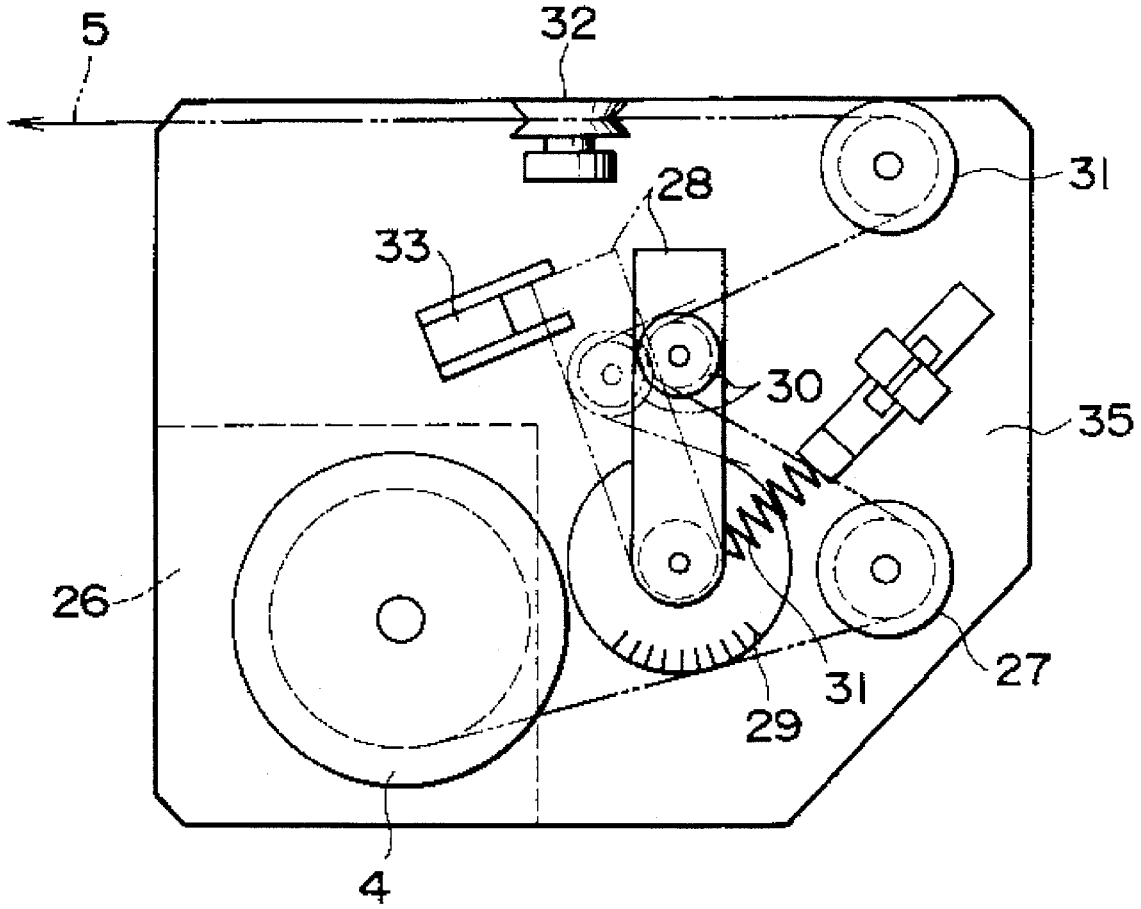
FIG. 6 is a plan view of a tension regulator of a damper wire.

FIG. 6 is a plan view of a tension regulator used for a damper wire 5. As described above, the damper wire 5 is drawn from the damper wire reel 4 (see FIG. 1(A)) by the wire clamper 6. At this time, it is undesirable that the tension of the damper wire be weak or excessively strong. Accordingly, the tension of the damper wire 5 is required to be kept substantially a constant value. The regulator in FIG. 6 is intended to keep the tension of the damper wire substantially a constant value.

In FIG. 6, the damper wire reel 4 is rotatively provided on a surface of a base 35. The rotational shaft of the damper wire reel 4 is directly connected (or connected through a gear) to the rotational shaft of a normally reversibly rotatable DC motor 26 provided on the rear surface of the base 25. There are provided a fixed idler gear 27, an arm 28 fixed at one end to a rotational shaft of a potentiometer 29, an idler gear 30 provided at the vicinity of the other end of the arm 28 and fixed idler gears 31 and 32. The damper wire 5 is drawn while being guided by the idler gears 27, 30, 31 and 32.

A spring 31 energizes the arm 28 counterclockwise in FIG. 6. A photosensor 33 detects the breakage of the damper wire 5. When the damper wire 5 is broken, the arm 28 is energized by the spring 31 and is turned counterclockwise in the direction shown by the two-dotted line. At this time, the leading edge of the arm 28 shields the optical path of the photosensor 33. The breakage of the damper wire 5 is judged on the basis of the shielding of the optical path of the photosensor 33, and an alarm is generated.

A potentiometer 29 converts a turning angle of the arm 28 into a resistance value. As a result, a motor 26 is controlled on the basis of the signal changed according to the resistance value. In the case where the tension of the damper wire 5 is excessively strong, the arm 28 is turned clockwise over the reference point. At this time, the motor 26 is rotated in the direction of feeding the damper wire or increases the rotational speed in this direction. On the other hand, in the case where the tension of the damper wire 5 is weak, the motor 26 is rotated in the direction of drawing the damper wire. Accordingly, the tension of the damper wire 5 is always kept at a constant value.

The present invention makes it easy to attach a stretched damper wire on an aperture grill of a cathode ray tube. Further, a stretched damper wire is automatically attached to an aperture grill of a cathode ray tube by the present invention.

Thus it is apparent that in accordance with the present invention, a method and apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A method of attaching a damper wire to a cathode ray tube, comprising the steps of:

positioning a pair of damper springs so as to be spaced at a predetermined interval;

clamping a damper wire wound around a damper reel with a wire clamper, said wire clamper being movable between at least said damper springs;

drawing said damper wire with said wire clamper so as to position said damper wire between said damper springs;

fixing said damper wire at a predetermined position with respect to each of said damper springs;

drawing a pair of ribbons from a pair of ribbon reels with a pair of ribbon clampers;

positioning each of said ribbons with respect to each of said damper springs so as to position said damper wire therebetween;

welding each of said ribbons to said damper springs at a first position thereof while holding said damper wire between each of said ribbons and each of said damper springs;

cutting each of said ribbons at a predetermined length;

cutting said damper wire projecting from said damper springs by clamping and drawing said damper wire with said wire clamper;

moving said damper springs so as to be perpendicular to a frame of an aperture grill of said cathode ray tube, said frame including two upstanding portions; and welding each of said damper springs at a second position thereof to each upstanding portion of said frame to provide said damper wire stretched between said damper springs on the aperture grill.

2. An apparatus for attaching a damper wire to a cathode ray tube, comprising:

a damper wire assembly forming apparatus for forming a damper wire assembly, said damper wire assembly having a pair of damper springs and a damper wire stretched between said damper springs;

a damper wire assembly welding apparatus including a positioning means for positioning said damper springs on a frame of an aperture grill of said cathode ray tube and a welding means for welding said damper springs to a pair of upstanding portions of said frame; and a damper assembly carrying mechanism for carrying said damper assembly formed by said damper assembly forming apparatus from said damper assembly forming apparatus to said damper assembly welding apparatus.

3. An apparatus for attaching a damper wire to a cathode ray tube according to claim 2, wherein said damper assembly carrying mechanism includes a carrying plate, an air cylinder for carrying said moving plate, a lift plate, a lifting cylinder for driving said lift plate, and a damper spring carrying part for carrying each of said damper springs.

4. An apparatus for attaching a damper wire to a cathode ray tube according to claim 3, wherein said damper spring carrying part includes a magnet.

5. A method of attaching a damper wire to a cathode ray tube, comprising the steps of:

positioning a pair of damper springs so as to be spaced at a predetermined interval;

clamping a damper wire wound around a damper reel with a wire clamper, said wire clamper being movable between at least said damper springs;

drawing said damper wire with said wire clamper so as to position said damper wire between said damper springs;

fixing said damper wire at a predetermined position with respect to each of said damper springs;

drawing a pair of ribbons from a pair of ribbon reels with a pair of ribbon clampers;

positioning each of said ribbons with respect to each of said damper springs so as to position said damper wire therebetween;

welding each of said ribbons to said damper springs at a first position thereof while holding said damper wire between each of said ribbons and each of said damper springs;

cutting each of said ribbons at a predetermined length;

cutting said damper wire projecting from one of said damper springs by clamping and drawing said damper wire with said wire clamper;

moving said wire clamper to the other of said damper springs;

cutting said damper wire projecting from the other of said damper springs by clamping and drawing said damper wire with said wire clamper;

moving said damper springs so as to be perpendicular to a frame of an aperture grill of said cathode ray tube, said frame including two upstanding portions; and welding each of said damper springs at a second position thereof to each upstanding portion of said frame to provide said damper wire stretched between said damper springs on the aperture grill.

* * * * *